United States Patent [19]

Takemura

[11] 4,233,073

[45] Nov. 11, 1980

[54] IRON-BASE SINTERED ALLOY FOR VALVE SEAT AND METHOD OF MAKING THE SAME

[75] Inventor: Kazutoshi Takemura, Kashiwazaki, Japan

[73] Assignee: Riken Piston Ring Industrial Co., Ltd., Tokyo, Japan

[21] Appl. No.: 899,110

[22] Filed: Apr. 24, 1978

[30] Foreign Application Priority Data

May 2, 1977 [JP] Japan ..... 52-49860

[51] Int. Cl.[2] ..... C22C 33/02; C22C 38/38; C22C 38/22; C22C 38/30

[52] U.S. Cl. ..... 75/243; 75/201; 75/213; 75/214; 75/246

[58] Field of Search ..... 75/236, 243, 246, 201, 75/213, 214, 227

[56] References Cited

U.S. PATENT DOCUMENTS

| | | | |
|---|---|---|---|
| 3,918,923 | 11/1975 | Inoue | 75/246 X |
| 3,982,905 | 9/1976 | Osawa et al. | 75/243 X |
| 3,982,907 | 9/1976 | Honma | 75/246 X |
| 4,021,205 | 5/1977 | Matsuda et al. | 75/246 |
| 4,080,205 | 3/1978 | Nimmi et al. | 75/246 X |

*Primary Examiner*—Richard E. Schafer

[57] ABSTRACT

An iron-base sintered alloy especially suitable for valve seat manufacture having excellent wear resistance and being able to be machine-cut is provided. The alloy is produced by combining specifically atomized pre-alloyed powder, iron powder, nickel powder and graphite powder by means of compacting and sintering processes, and has a microstructure comprising pearlite and globular hard alloy phase formed with said atomized pre-alloyed hard alloy powder uniformly dispersed in said pearlite and martensite surrounding said hard alloy phase.

2 Claims, 6 Drawing Figures

IRON-BASE SINTERED ALLOY FOR VALVE SEAT AND METHOD OF MAKING THE SAME

FIELD OF THE INVENTION

The present invention relates to an improvement made on sintered alloy for valve seat of an internal combustion engine, especially of a diesel engine, and particularly to such alloy having excellent wear resistance to repetitive hot impacts and being machinable without difficulty.

The present invention further relates to a method of making such sintered alloy.

DESCRIPTION OF THE PRIOR ART

With the recent trend in a design of internal combustion engines in which they have been gradually small-sized and power-raised-up, the valve seat is subject to hot impact with a valve face at a temperature of 700°-800° C., and therefore high wear resistance to such a severe condition is required for the valve seat.

Inventor has developed several iron-base sintered alloys which satisfy the above-mentioned requirement, as a result of study, and disclosed some of them previously, for example in U.S. Patent application Ser. No. 855,964.

Above-mentioned invention relates to an iron-base sintered alloy suitable for valve seat manufacture having chemical composition by weight of 0.6–1.5% carbon, 1.0–8.0% chromium, 0.25–4.0% tungsten, 2.0–12.0% cobalt and balance essentially iron, and having a microstructure comprising pearlite and globular hard alloy phase uniformly dispersed in said pearlite, and hard alloy phase being formed with atomized powder of pre-alloyed hard alloy having chemical composition by weight of 1.0–3.0% carbon, 20–40% chromium, 5–20% tungsten and 40–60% cobalt, and also relates to a method of making the same.

Valve seat made from the above-mentioned sintered alloy has excellent durability for gasoline engine even if unleaded gasoline or LPG is used as fuel.

For diesel engine, however, this valve seat does not have enough durability.

Valve seat of diesel engine is used under more severe condition than in the case of gasoline engine, because combustion pressure and temperature in diesel engine are higher than these in gasoline engine, so that, when sulphur and/or vanadium are existing in the fuel, the valve seat of diesel engine easily wears out accompanying with chemical corrosion.

At the present time, sintered alloy is not used as material for the valve seat of diesel engine, but chromium-molybdenum chilled cast iron and Stellite coated material are used. These materials, however, have disadvantage of increasing cost, because they are difficult to machine-cut, and additionally, they must be ground off for finishing the surface more amount than that of sintered alloy.

SUMMARY OF THE INVENTION

The object of the present invention is, accordingly, to provide novel iron-base sintered alloy, having satisfactory durability for valve seat of diesel engine and being able to be machine-cut easily.

The alloy relating to the present invention is produced by adding nickel to the iron-base sintered alloy of the previous invention in the U.S. Patent application Ser. No. 855,964, and improved in durability greatly by the formation of suitable amount of martensite. This alloy is characterized by the microstructure comprising pearlite and spherical form hard alloy phase being formed with pre-alloyed and atomized powder of the hard alloy consisting of 1.0–3.0% (hereinafter, % means weight percent) carbon, 20–40% chromium, 10–20% tungsten and 40–60% cobalt (hereinafter called as 2C-30Cr-15W-Co alloy) and being uniformly dispersed in said pearlite and martensite surrounding said hard alloy phase.

Another object of the present invention is to provide the method of producing such sintered alloy.

DETAILED DESCRIPTION OF THE INVENTION

One of the characteristics of the present invention is that the sintered alloy having specific structure comprising pearlite, hard alloy phase in a spherical form of C-Cr-W-Co system and martensite surrounding said hard phase, provides an improved wear resistance to repetitive hot impacts. The hard metallic phase is composed of 2C-30Cr-15W-Co pre-alloyed powder fabricated by atomization process.

The atomized powder is generally of spherical form, and easy to hold its spherical form in the sintering process since the elements composing the hard phase do not excessively diffuse into the pearlite owing to its small contact surface with surrounding pearlite, and further prevents so-called Kirkendall effect in which a number of voids are produced in the hard phase because of the difference between the mutual diffusion speeds of the pearlite and the hard phase.

In the results, the alloys of the present invention inhibit "notch effect" and so-called pitting, i.e. surface tearing-off under repetitive impacts and are also able to be machine-cut without any difficulty.

Mixed powder of the hard alloy and iron powder has a high fluidity and so extends the die life, in addition, may be easily compacted into a desired dimension which may reduce the dimensional fluctuation. Accordingly, the valve seat of the present invention has an economical advantage that the valve seats having an inner diameter within a predetermined tolerance may be formed without subsequent mechanical processing.

The other features of the present invention may be apparent from the following detailed disclosure in connection with the accompanying drawings.

Figure 1:
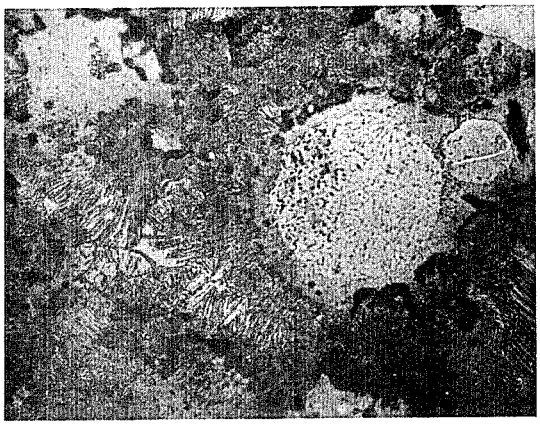
FIG. 1 is a microscopic photograph (×400) showing the structure of the sintered iron-base alloy of the present invention.

Referring now to FIG. 1 which is showing the microstructure of sintered iron-base alloy of the present invention, a large white spherical phase in the structure is the hard alloy phase and the surrounding gray area is martensite formed by diffusion of chromium and tungsten from hard alloy, and the other portion is pearlite.

Mechanically pulverized 2C-30Cr-15W-Co powder is not suitable to produce the said microstructure; because it has irregular shape and has very wide surface area, so that the diffusion of elements from the hard phase to the surrounding pearlite during sintering increases, and large voids are formed in the hard alloy phase by Kirkendall effect.

This global shape of the hard phase in the present invention may be obtained by the use of atomized powder as stated above, and further by a suitable selection of chemical composition to prevent diffusion of constituents of the hard phase during the sintering process. This chemical composition of the hard alloy powder will be explained in the following;

Chromium combines with carbon to form carbide and raises the hardness of hard alloy. This element, however, easily diffuses during sintering into the surrounding pearlite and produces martensite which impairs machinability, and further generates a number of voids by Kirkendall effect in and around the hard phase which deteriorates anti-pitting property. In the present invention, a considerable amount of cobalt is incorporated to stabilize pearlite and to repress the excessive diffusion of chromium and retain the globular form of the hard phase. However, chromium content should be restricted to a range of 20–40%. An amount less than 20% of chromium is insufficient to form the desired amount of carbide, and an amount more than 40% thereof will accelerate the diffusion into the surrounding phase, as a result, producing a number of voids which lower anti-pitting property and the formed martensite impairs machinability as mentioned above.

Tungsten enhances the hardness of the hard alloy phase by the formation of MC-type carbide and double carbide with cobalt, but an amount less than 10% gives a little effect, and a larger amount will cause an undesirable martensite formation impairing the machinability and increasing the production cost; although the hardness is enhanced. Therefore, the amount of tungsten should be less than 20%. So, the content of tungsten should be 10–20%.

Carbon produces carbides with chromium, tungsten and cobalt in the hard phase and enhances the hardness, and the amount should be restricted in a range of 1–3%, because the lesser amount gives a little effect, whereas, the larger amount produces much amount of carbide which makes products brittle, and when used as valve seat the product tends to subject to tearing-off due to crackings in the hard phase.

Cobalt has an important role that it prevents the excessive diffusion of chromium and tungsten from the hard phase into surrounding pearlite during sintering to form martensite excessively. The content of cobalt is generally a balance reducing the sum of the above-mentioned carbon, chromium, and tungsten from the total amount of the constituents, preferably in a range of 40–60%. The amount lesser than 40% is insufficient to prevent the martensite formation, and the amount larger than 60% reduces wear resistance due to the lowered hardness.

To maintain the above-mentioned role of cobalt, it is necessary to pre-alloy cobalt with chromium and tungsten. If cobalt powder is added separately to mixed powders, not only a large amount of cobalt is required to prevent the martensite formation but also causes decarburization during sintering due to an accelerated diffusion of carbon. While a higher content of cobalt lowers the melting temperature of hard alloy to facilitate atomization of powder, for the purpose of improvement of fluidity of the melt for atomization and in view of deoxidation and production cost, 1–5% out of 40–50% cobalt may be replaced with silicon, nickel or molybdenum, and less than 10% may be substituted with iron powder.

Composition of the iron-base alloy of the present invention containing global hard phase primarily depends on blending ratio of the ingredients. Specifically, an amount less than 5% of 2C-30Cr-15W-Co powder can not attain the desired wear resistance, and the larger amount thereof deteriorates compactibility, density, wear resistance and machinability of the final products, and therefore the maximum amount of the pre-alloyed powder should be restricted to 20%. In this manner, the respective contents in the sintered alloy for valve seat of the present invention are calculated as chromium 1.0–8.0%, tungsten 0.5–4.0%, and cobalt 2.0–12.0%.

Nickel may be added by an amount 1.0–5.0% to form martensite in cooperation with chromium and tungsten in the portion into which chromium and tungsten diffused from hard alloy phase in order to increase hardness and improve wear resistance, and further to improve the strength of pearlite and also to obtain dimensional stability. An amount less than 1.0% of nickel gives a little effect, and larger amount thereof will produce an excessive martensite formation and impair the machinability.

Further, carbon contained chemically in the matrix improves hardness, flexural strength and wear resistance of the sintered alloy, so its content should be selected as 0.6–1.5%. When the carbon content of the matrix is less than 0.6%, primary ferrite rich structure is formed which results in insufficient strength and wear resistance, while the content more than 1.5% forms primary cementite rich structure which makes the products brittle. So, carbon content of the sintered alloy amounts to 0.6–2.1%, by adding carbon content in the matrix to that in hard alloy phase.

Thus, the chemical composition of the sintered alloy of the present invention is substantially 0.6–2.1% C, 1.0–8.0% Cr, 0.5–4.0% W, 2.0–12.0% Co, 1.0–5.0% Ni, and balance essentially Fe.

Compacting or consolidating, and sintering operations of the sintered alloy of the present invention are to be carried out in a usual manner except sintering temperature and time. In other words, mixed powder having the above-mentioned composition added with an adequate amount of lubricant is charged into a metallic mold, compacted at a pressure of 4–7 t/cm$^2$, and sintered at a temperature of 1100°–1200° C. for 30–60 minutes in a vacuum or an appropriate reducing atmosphere. Under a temperature below 1100° C., sintering is insufficient and resulting strength is rather low, whereas at a higher temperature, chromium and tungsten diffuse out of the hard phase and produce an excessive amount of martensite which impairs machinability. Therefore, the maximum sintering temperature is advantageously 1200° C.

Then, the sintered product is cooled in the sintering furnace. Usually, cooling rate is about 10° C./minute in the vacuum batch sintering furnace and is 40°–60° C./minute in the mesh-belt type sintering furnace.

Thus the iron-base sintered product having a density of 6.8–7.3 g/cc and including globular hard alloy phase having micro-Vickers hardness of 500–1200 uniformly dispersed in pearlitic matrix and martensite surrounding said globular hard alloy phase is produced.

An electron image and X-ray image of the sintered alloy of the present invention are shown in FIGS. 2–6.

Figure 2:
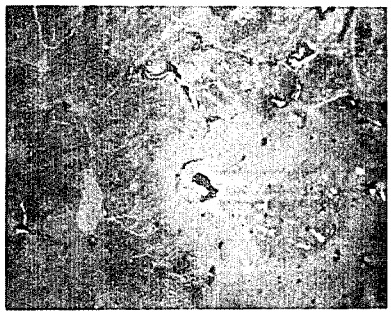
FIG. 2 is a photograph of backscattered electron image (×400) by scanning X-ray microanalyser showing the structure of the sintered iron-base alloy of the present invention.
Figure 3:
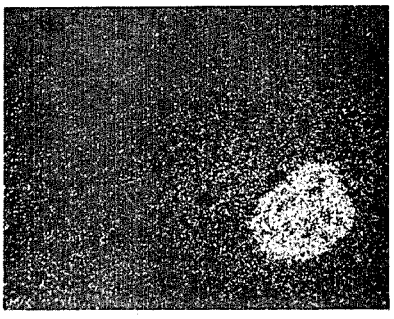
FIG. 3 is a photograph of $K_\alpha$ X-ray image of chromium at the same portion of FIG. 2.
Figure 4:
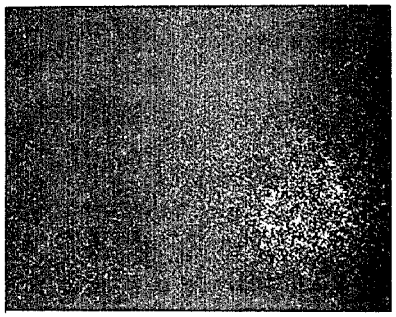
FIG. 4 is a photograph of Kα X-ray image of tungsten at the same portion.
Figure 5:
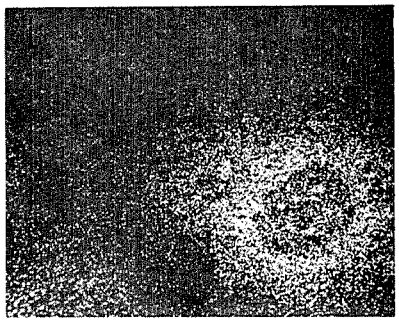
FIG. 5 is a photograph of Kα X-ray image of cobalt at the same portion.
Figure 6:
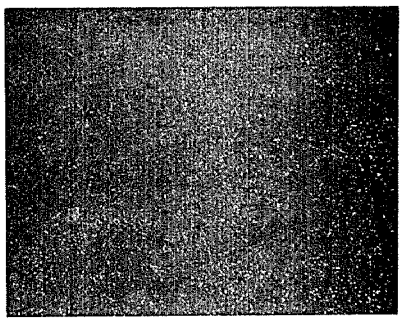
FIG. 6 is a photograph of Kα X-ray image of nickel at the same portion.

In FIG. 2, a gray ball is hard phase, and white portion surrounding said hard alloy is martensite, and the other portion is pearlite. FIG. 3 shows distribution of chromium at the same portion of FIG. 2. FIG. 4 shows distribution of tungsten. FIG. 5 shows distribution of cobalt at the same portion. And FIG. 6 shows distribution of nickel at the same portion.

From these figures, it may be understood, that the concentration of chromium and tungsten in the portion surrounding hard alloy phase are high according to the diffusion of these elements from said hard alloy phase and, in this range, martensite is formed. Nickel distributes uniformly in the matrix. Cobalt diffuses into surrounding portion from said hard alloy phase. Cobalt does not contribute to the formation of martensite, but stabilizes the pearlite.

And it may be understood, that under the existing of nickel, chromium and tungsten diffused from hard alloy phase, form martensite in the diffused area, overcoming the action of cobalt to stabilize pearlite.

DETAILED DESCRIPTION OF THE PREFERRED EMBODIMENT

Atomized 2C-30Cr-15W-Co powder (−100 mesh) having a chemical composition of 2.5% C, 33.0% Cr, 12.0% W, and balance essentially Co was admixed with graphite powder (−100 mesh), carbonyl nickel powder (maximum size of 10 micron) and atomized iron powder (−100 mesh) to give composition as shown in Table 1.

TABLE 1

| | 2C-30Cr-15W-Co atomized powder (%) | carbonyl nickel powder (%) | graphite powder (%) | iron powder (%) | density (g/cc) | hardness (Rockwell B-scale) | crushing strength (kg/mm$^2$) |
|---|---|---|---|---|---|---|---|
| A | 15 | 2 | 1.2 | bal. | 7.10 | 100 | 85 |
| B | 10 | 1 | 1.2 | bal. | 7.15 | 97 | 94 |

To the mixture, 0.7% of zinc stearate powder was added as a lubricant, and the mixed powder was compacted in a die at a pressure of 6 ton/cm$^2$, and then sintered in a vacuum for 50 minutes at a temperature of 1180° C. Density, Rockwell hardness B-scale and radial crushing strength of the resulting sintered product are shown together in Table 1.

Valve seats for test were prepared with these sintered products and installed as inlet and exhaust valve seats in the cylinder head of a 4-cylinder 2200 cc displacement water-cooled diesel engine. Bench tests were carried out under full-load of 4000 rpm for 60 hours, and wear of the valve seats was determined comparing the recession of test valve seats with that of standard valve. Contact surface of mating valve is coated with Stellite.

The test results are shown in Table 2 and Table 3. Table 2 shows the amount of wear of exhaust valve seat, and Table 3 shows the amount of wear of inlet valve seat.

TABLE 2

| | 1st cylinder | 2nd cylinder | 3rd cylinder | (mm) 4th cylinder |
|---|---|---|---|---|
| A | 0.02 | 0.00 | 0.02 | 0.01 |
| B | 0.05 | 0.03 | 0.03 | 0.02 |
| C | 0.19 | 0.08 | 0.13 | 0.05 |

TABLE 3

| | 1st cylinder | 2nd cylinder | 3rd cylinder | (mm) 4th cylinder |
|---|---|---|---|---|
| A | 0.05 | 0.11 | 0.09 | 0.02 |
| B | 0.10 | 0.10 | 0.13 | 0.07 |
| D | 0.35 | 0.30 | 0.38 | 0.27 |

Test valve seat C is made from chilled cast iron having a chemical composition of 2% C, 13% Cr, 1.5% Mo, 1% V and balance essentially iron and Rockwell hardness C-scale 53, and test valve seat D is made from chilled cast iron having a chemical composition of 2% C, 3% Cr, 1% Mo and balance essentially iron and Rockwell hardness C-scale 57. Both of them were tested for comparison as valve seat of diesel engine in currently use.

And then, depth of annular wear groove of inlet valve surface was determined. The results are shown in Table 4. Annular wear groove of exhaust valve is very small and not determined.

TABLE 4

| | 1st cylinder | 2nd cylinder | 3rd cylinder | (mm) 4th cylinder |
|---|---|---|---|---|
| A | 0.09 | 0.07 | 0.05 | 0.06 |
| B | 0.04 | 0.02 | 0.03 | 0.03 |
| D | 0.09 | 0.08 | 0.11 | 0.08 |

Table 2 and Table 3 evidently show smaller recession of the valve seats A and B which were made accordingly to the present invention, than that of the valve seats C and D made from currently available valve seat alloys for diesel engine.

Additionally, Table 4 evidently shows smaller wear of valve surface opposed to the test valve seats A or B than that of valve seats C and D.

What is claimed is:

1. Wear resistant and machinable sintered iron-base alloy especially suitable for valve seat manufacture, having a chemical composition by weight of 0.6–2.1% carbon, 1.0–8.0% chromium, 0.5–4.0% tungsten, 2.0–12.0% cobalt, 1.0–5.0% nickel and balance essentially iron, having a microstructure comprising pearlite and globular hard alloy phase uniformly dispersed in said pearlite with martensite surrounding said hard alloy phase being formed with atomized powder of pre-alloyed hard metal having chemical composition by weight of 1.0–3.0% carbon, 20–40% chromium, 10–20% tungsten and 40–60% cobalt.

2. Method of producing sintered iron-base alloy especially suitable for valve seat manufacture, comprising the steps of mixing 5–20% by weight of pre-alloyed and atomized hard alloy powder having chemical composition by weight of 1.0–3.0% carbon, 20–40% chromium, 10–20% tungsten and 40–60% cobalt; 0.6–1.5% graphite powder, 1.0–5.0% nickel powder and remainder of iron powder; compacting the mixture into a desired shape; and sintering said compacted mixture at a temperature ranging 1100° to 1200° C., then cooling said compacted and sintered mixture to a room temperature.

* * * * *